US006931880B2

(12) United States Patent
Aflekt et al.

(10) Patent No.: US 6,931,880 B2
(45) Date of Patent: Aug. 23, 2005

(54) METHOD AND ARRANGEMENT FOR DEFROSTING A VAPOR COMPRESSION SYSTEM

(75) Inventors: Kåre Aflekt, Trondheim (NO); Einar Brendeng, Trondheim (NO); Armin Hafner, Trondheim (NO); Petter Nekså, Trondheim (NO); Jostein Pettersen, Ranheim (NO); Håvard Rekstad, Trondheim (NO); Geir Skaugen, Trondheim (NO); Gholam Reza Zakeri, Trondheim (NO)

(73) Assignee: Sinvent AS, Trondheim (NO)

( * ) Notice: Subject to any disclaimer, the term of this patent is extended or adjusted under 35 U.S.C. 154(b) by 0 days.

(21) Appl. No.: 10/362,756

(22) PCT Filed: Aug. 31, 2001

(86) PCT No.: PCT/NO01/00354

§ 371 (c)(1),
(2), (4) Date: Jul. 21, 2003

(87) PCT Pub. No.: WO02/18854

PCT Pub. Date: Mar. 7, 2002

(65) Prior Publication Data

US 2004/0103681 A1 Jun. 3, 2004

(30) Foreign Application Priority Data

Sep. 1, 2000 (NO) ..... 20004369
Nov. 3, 2000 (NO) ..... 20005575

(51) Int. Cl.[7] ..... F25B 47/00
(52) U.S. Cl. ..... 62/277; 62/81; 62/324.1
(58) Field of Search ..... 62/277, 278, 196.4, 62/156, 81, 324.1

(56) References Cited

U.S. PATENT DOCUMENTS

| | | | | |
|---|---|---|---|---|
| 4,356,703 A | * | 11/1982 | Vogel | 62/155 |
| 4,437,317 A | * | 3/1984 | Ibrahim | 62/81 |
| 4,625,524 A | * | 12/1986 | Kimura et al. | 62/278 |
| 4,691,527 A | | 9/1987 | Ikeda | |
| 5,575,158 A | | 11/1996 | Vogel | |
| 6,029,465 A | | 2/2000 | Bascobert | |

FOREIGN PATENT DOCUMENTS

| | | |
|---|---|---|
| DE | 2648554 | 11/1977 |
| DE | 19517862 | 11/1996 |
| GB | 786369 | 11/1957 |

* cited by examiner

*Primary Examiner*—Melvin Jones
(74) *Attorney, Agent, or Firm*—Wenderoth, Lind & Ponack. L.L.P.

(57) ABSTRACT

A method of defrosting of a heat exchanger (evaporator) in a vapor compression system including, downstream of a heat exchanger (evaporator) (3) to be defrosted, at least a compressor (1), a second heat exchanger (condenser/heat rejecter) (2), and an expansion device (6) connected by conduits in an operable manner to form an integral closed circuit. The heat exchanger (3) to be defrosted is subjected to essentially the same pressure as the compressor's (1) discharge pressure. Thus, the heat exchanger (3) is defrosted as the high-pressure discharge gas from the compressor (1) flows through to the heat exchanger, giving off heat to the heat exchanger (3). In the circuit, in connection with the expansion device (6) a first bypass loop 23 with a first valve (16'), is provided. A pressure reducing device (6') is provided in a second bypass loop in conjunction with a second valve (16''') disposed downstream of the heat exchanger (3) being defrosted, whereby the first valve (16') is open and the second valve (16''') is closed when defrosting takes place.

20 Claims, 7 Drawing Sheets

METHOD AND ARRANGEMENT FOR DEFROSTING A VAPOR COMPRESSION SYSTEM

FIELD OF THE INVENTION

The present invention relates to a method and arrangement for defrosting of the heat exchanger (evaporator) in a refrigeration or heat pump system. In addition to the first heat exchanger (evaporator), the arrangement includes at least a compressor, a second heat exchanger (heat rejecter) and an expansion device connected by conduits in an operable manner to form an integral closed circuit.

DESCRIPTION OF PRIOR ART

In some applications such as an air-source heat pump or air-cooler in a refrigeration system, frost will form on the heat absorbing heat exchanger (functioning as an evaporator) when the surrounding temperature is near or below the freezing point of water. The heat exchanger heat transfer capability and resulting system performance will be reduced due to frost buildup. Therefore a defrosting means is required. The most common defrosting methods are electric and hot gas defrosting. The first method (electric defrosting) is simple but not efficient, while the hot gas defrosting method is most suitable when the system has two or more evaporators. In both cases, for a heat pump system, an auxiliary heating system has to be activated in order to meet the heating demand during the defrosting cycle.

In this regard, U.S. Pat. No. 5,845,502 discloses a defrosting cycle in which the pressure and temperature in the exterior heat exchanger is raised by a heating means for the refrigerant in an accumulator without reversing the heat pump. Although this system improves the interior thermal comfort by maintaining the heat pump in the heating mode, the defrosting process does still require that the heating means must be large enough in order to raise the suction pressure and corresponding saturation temperature to above the freezing point of water (frost). This aspect might limit, for practical reasons, the type of heating means (energy sources) that can be used with this defrosting method (radiator system). According to the patent, the defrosting cycle is meant to work only with a reversible heat pump. Yet another disadvantage of this known system is that the refrigerant temperature in the accumulator needs to be higher than 0 degrees centigrade, and this may limit the effective temperature difference available for heat transfer to the accumulator.

Finally, another disadvantage of this system is that the refrigerant temperature in the heat exchanger to be defrosted will be relatively low, and the defrosting time will have to be long in order to melt the frost.

SUMMARY OF THE INVENTION

The present invention solves the disadvantages of the aforementioned systems by providing a new, improved, simple and effective method and arrangement for defrosting the evaporator of a refrigeration or heat pump system.

In particular, the heat exchanger to be defrosted is subjected to essentially the same pressure as the compressor's discharge pressure. Thus, the heat exchanger is defrosted as the high-pressure discharge gas from the compressor flows through the heat exchanger giving off heat to the heat exchanger.

Furthermore, in the circuit, in connection with the expansion device, a first bypass loop with a first valve is provided, and a pressure reducing device is provided in a second bypass loop in conjunction with a second valve disposed downstream of the heat exchanger 3 to be defrosted. Thus, the first valve is open and the second valve is closed when defrosting takes place.

BRIEF DESCRIPTION OF THE DRAWINGS

The invention is described in more detail by referring to the following figures.

DETAILED DESCRIPTION OF THE INVENTION

Figure 1:
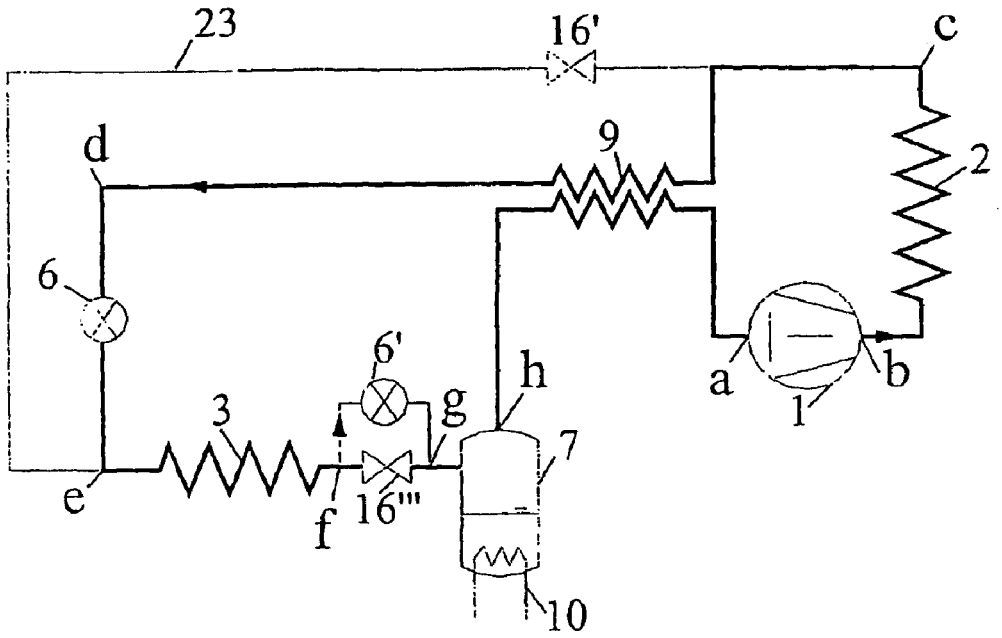
FIG. 1 and FIG. 2 show schematic representations of the principle of a defrosting cycle operation according to the present invention.

The invention relates generally to refrigeration and heat pump systems, more specifically but not limited, operating under a transcritical process, to defrost a frosted heat exchanger. In particular, the invention relates to an evaporator with any fluid as refrigerant, and in particular carbon dioxide.

The invention can be used with any refrigeration or heat pump system preferably having a pressure receiver/accumulator. If necessary, the invention can also eliminate cool interior drafts during the defrost cycle, which are associated with conventional defrosting methods in heat pump systems. This is achieved by means of an external heat source such as an electrical resistance or waste heat system (for example from a car radiator cooling system) or any other appropriate means that can be incorporated into the receiver/accumulator or connecting piping along the path of the refrigerant in the circuit. Heat can also be supplied from a storage unit. The invention can be used with both subcritical and transcritical refrigeration and heat pump systems with a receiver/accumulator. The present invention can also be implemented with refrigeration and heat pump systems having only one evaporator.

The method of defrosting cycle operation according to this invention that follows is described with reference to FIGS. 1 and 2, and can be applied to either a heat pump system or a refrigerating (cooling) system. The system includes a compressor 1, a first heat exchanger to be defrosted 3, a third heat exchanger 9, two expansion devices (a first 6 and a second 6'), a second heat exchanger 2 (heat rejecter), valves 16' and 16''', a receiver/accumulator 7, and a heating device 10. The second expansion device 6' is provided in a bypass conduit loop relative to the valve 16''' disposed downstream of the heat exchanger (evaporator) 3. The addition of heat by a heating device and the provision of the second expansion device 6' bypassing the valve 16''' and the valve 16' bypassing the first expansion device 6, represents the major novel feature of the invention and makes it possible to subject the heat exchanger 3 to defrosting by maintaining essentially the same pressure in the heat exchanger as the discharge pressure of compressor 1. Thus, the heat exchanger 3 is defrosted as the high-pressure discharge gas from the compressor 1 flows through to the heat exchanger giving off heat to the heat exchanger 3. The heating device 10 adds heat to the refrigerant, preferably via a pressure receiver/accumulator 7, but the heat can also be alternatively or additionally added to the refrigerant anywhere in the system along the path of refrigerant during defrost cycle.

The Normal Operation (FIG. 1):

Under normal operation, the second expansion device 6' which is provided in a bypass loop relative to the valve 16''', and valve 16'' which is provided in a bypass loop relative to the first expansion device 6 are closed while valve 16''' is open. It is also understood that the second expansion device 6' can be a capillary tube or similar device which technically speaking will not be "closed", but there will be practically no refrigerant flow during normal operation. The circulating refrigerant evaporates in the exterior heat exchanger 3. The refrigerant enters into the receiver/accumulator 7 before passing through the internal (third) heat exchanger 9 where it is superheated. The superheated refrigerant vapor is drawn off by the compressor 1. The pressure and temperature of the vapor is then increased by the compressor 1 before it enters the second heat exchanger (heat rejecter) 2. Depending on the pressure, the refrigerant vapor is either condensed (at sub-critical pressure) or cooled (at supercritical pressure) by rejecting heat. The high-pressure refrigerant then passes through internal (third) heat exchanger 9 before its pressure is reduced by the expansion device 6 to the evaporation pressure, completing the cycle.

Figure 2:
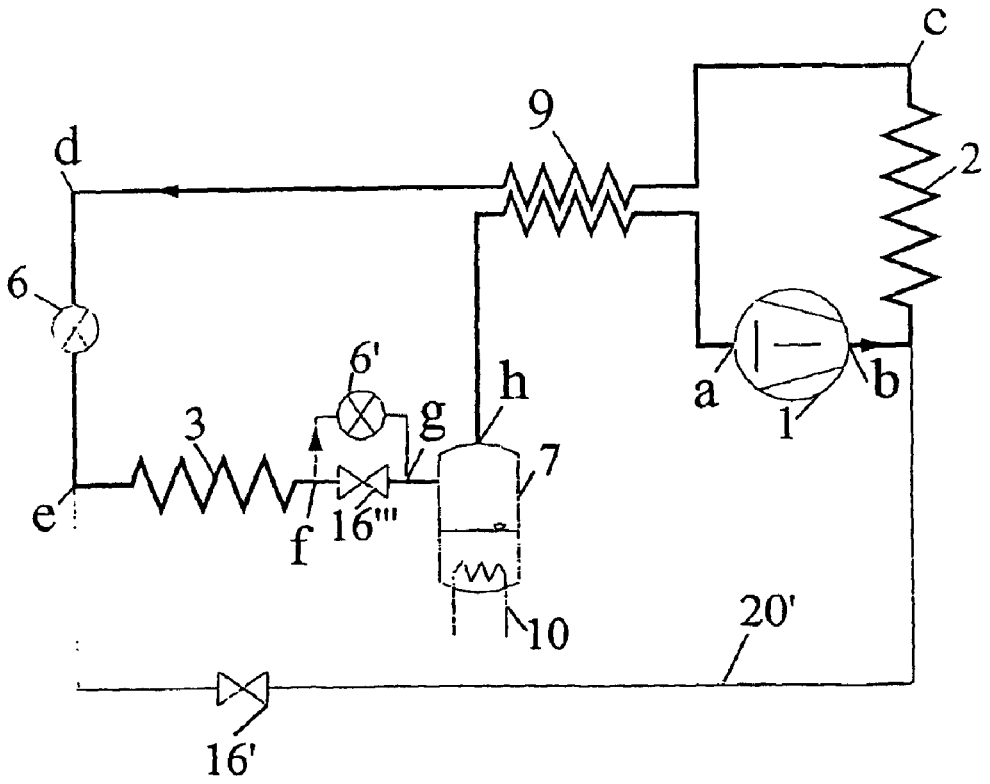

Defrost Cycle:

With reference to FIG. 1, upon commencing of defrost cycle, valve 16' will be open and valve 16''' will be closed. According to this invention, the second heat exchanger (heat rejector) 2 and the first heat exchanger (evaporator) 3 will be coupled in series or parallel and experience, as stated above, almost the same pressure as the discharge pressure of the compressor. The heat exchanger 2 can also be bypassed if necessary. This can be the case in refrigeration systems where there is no need for heat rejection by the heat exchanger during the defrosting cycle. (FIG. 2).

The temperature and pressure of the refrigerant vapor is raised by the compressor 1 before it enters the heat exchanger 2. In case of heat pump operation where there is a need for heat delivery during defrost cycle, the refrigerant vapor is cooled by giving off heat to the heat sink (interior air in the case of an air system). The high-pressure refrigerant can pass through the internal heat exchanger 9 or can be alternatively bypassed (as shown in FIG. 1), before it enters the heat exchanger (evaporator) 3 that is to be defrosted, through the valve 16'. The cooled refrigerant at the outlet of the heat exchanger 3 then passes though the expansion valve 6' by which its pressure is reduced to the pressure in the receiver/accumulator 7. Heat is preferably added to the refrigerant in the receiver/accumulator 7 to evaporate the liquid refrigerant that enters the receiver/accumulator 7.

The type of application and its requirements determine the type of heating device and amount of heat needed in order to carry out the defrosting process. For example, using a compressor with a suction gas cooled motor, the heat given off by the motor and/or heat of compression can be used as the "heat source" in order to add heat to the refrigerant during the defrosting cycle with a minimum amount of energy input. The drawings show some experimental results using a suction gas cooled compressor in which heat of compression and heat given off by the compressor motor was used as the "heat source". In the case of a water heater heat pump system, the heat accumulated in the water in the heat rejector and/or the hot water storage tank can be used as the "heat source".

Using supercritical heat rejection pressure, there is an additional "degree of freedom" which adds further flexibility to this invention. While in a sub-critical system the pressure (and saturation temperature) in the condenser (heat exchanger 2) is automatically determined by the balance of the heat transfer process in the heat exchanger (heat rejecter), and the supercritical pressure can be actively controlled to optimize the process and heat transfer performance.

Figure 3:
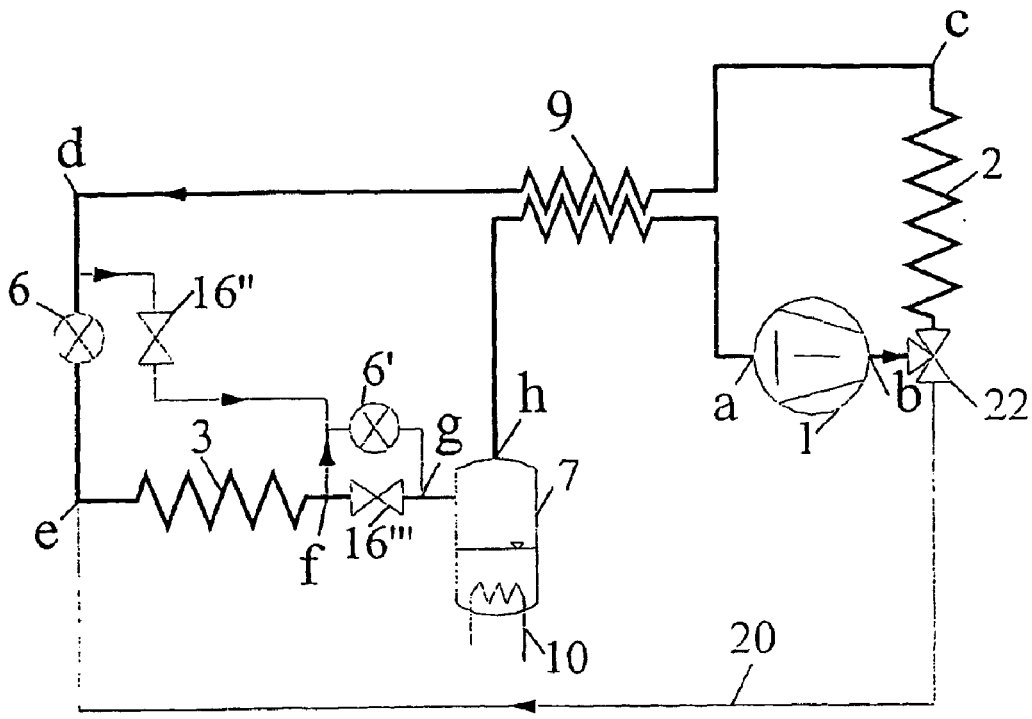
FIGS. 3 and 4 show schematic representations of embodiments of the invention shown in FIGS. 1 and 2.

FIG. 3 shows a further embodiment of the invention in which the heat exchangers 2 and 3 are coupled in parallel by means of a 3-way valve 22. Depending on the desired speed of defrosting and heating effectiveness, part of the refrigerant from the compressor is supplied to the heat exchanger 3 through a first bypass loop 20. Refrigerant supplied from the heat exchanger 2, in this example, bypasses the heat exchanger 3 by opening the valve 16'' in a second bypass loop.

Figure 4:
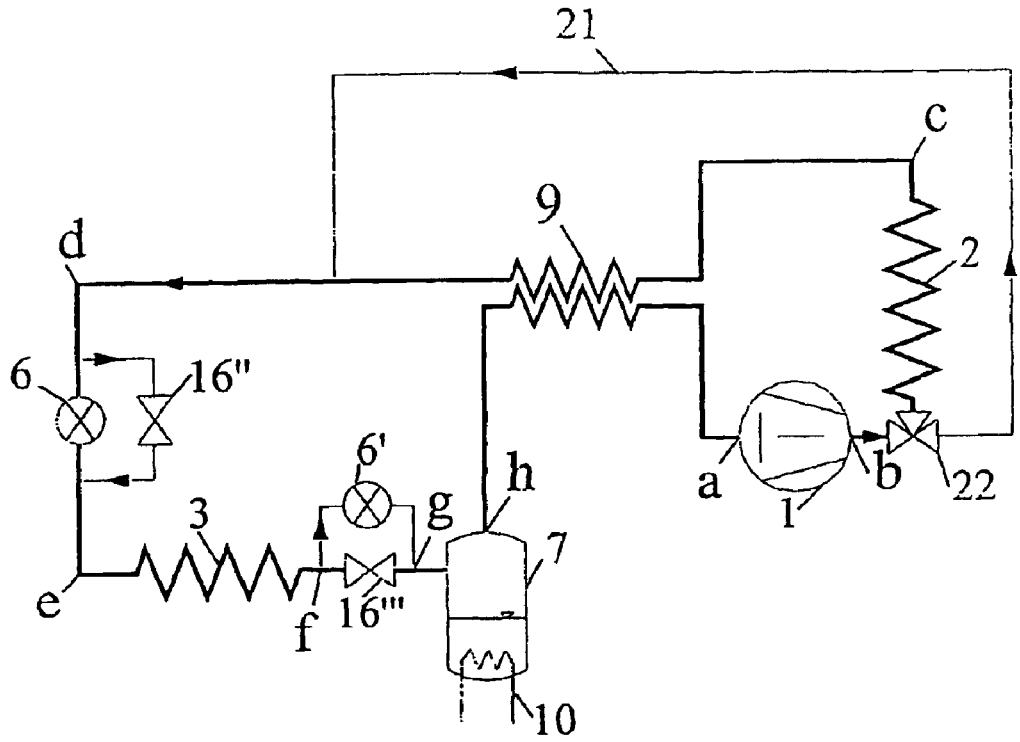

Further, FIG. 4 shows another embodiment in which a 3-way valve 22 is used to bypass, partly or wholly, the heat exchanger 2 (heat rejecter) through another conduit loop 21. This embodiment is useful in situations where speedy defrosting is desired.

Figure 5:
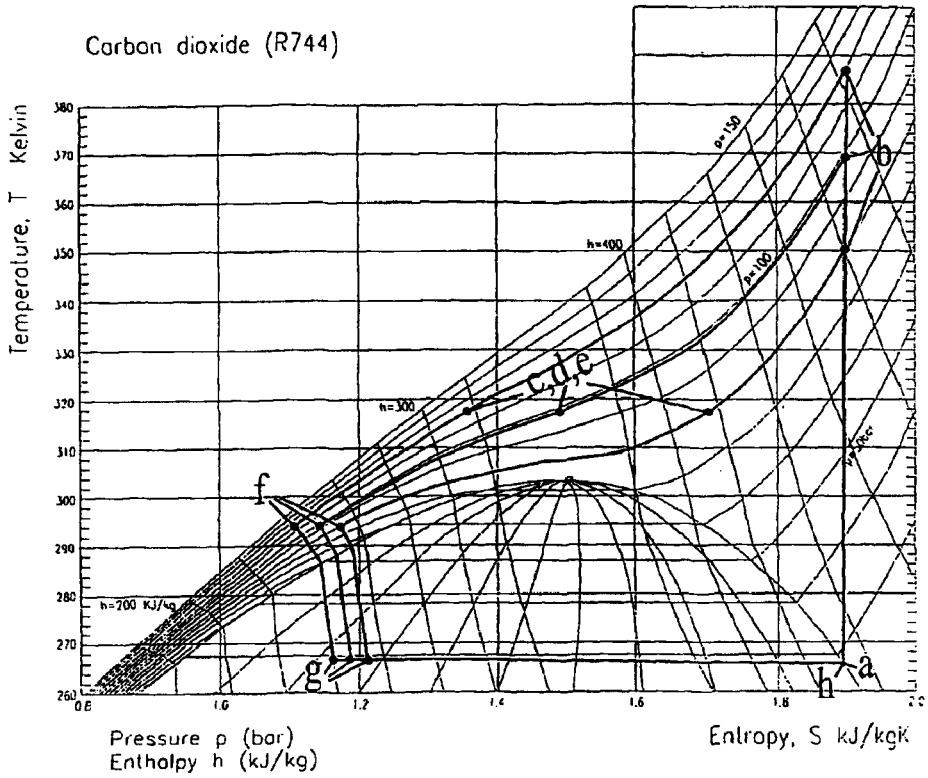
FIG. 5 is a T-S diagram for the process using the defrosting method according to FIG. 1.

According to the invention, the supercritical pressure can be actively controlled to increase the temperature and specific enthalpy of the refrigerant downstream of the compressor 1 during the defrosting cycle which is shown in FIG. 5. The higher refrigerant-specific enthalpy downstream of the compressor 1 (point b in the diagram) is the result of increased compression work when the discharge pressure is increased. In this respect, the possibility to increase the compression work can be regarded as a "reserve heating device" for the defrosting method. As an example, this feature of the invention can be useful to meet the interior thermal comfort requirement, in a heat pump system, during a defrost cycle with high heating demand. It is also possible to perform defrosting while running the second heat exchanger (condenser) 2 and the first heat exchanger to be defrosted (evaporator) 3 in parallel instead of series during the defrost cycle.

Figure 6:
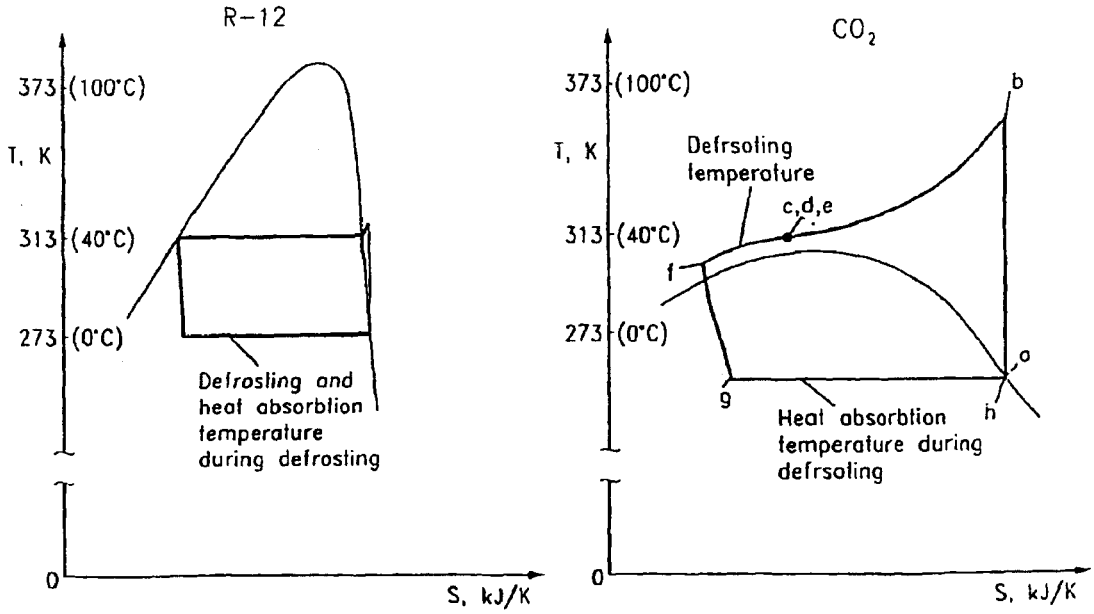
FIG. 6 are diagrams illustrating a comparison of a heating process for $CO_2$ and R12 in temperature/entropy (T-S) diagrams where the defrost process for R12 corresponds to the process according to U.S. Pat. No. 5,845,502.

The increased defrosting effect (specific enthalpy due to increased work) of the invention compared to the solution shown in, for instance, U.S. Pat. No. 5,845,502 is further shown in FIG. 6. The diagram on the right hand side represents the process of the invention, while the diagram on the left hand side represents the process of the US patent. As can be clearly seen, the defrost temperature is much higher with the present invention.

In applications other than heat pump or heat recovery systems, the main objective is to complete the defrost cycle as fast and efficiently as possible. In these cases, the heat exchanger 2 (heat rejector) can be bypassed during the defrost cycle as illustrated in FIG. 2, in which a bypass conduit loop with a valve 16 is provided, and which in such case is open. The defrost cycle can therefore be carried out faster than in the previous case.

Likewise the internal heat exchanger 9 may be bypassed by means of a conduit loop with valve 16' as is shown in FIG. 1.

Figure 7:
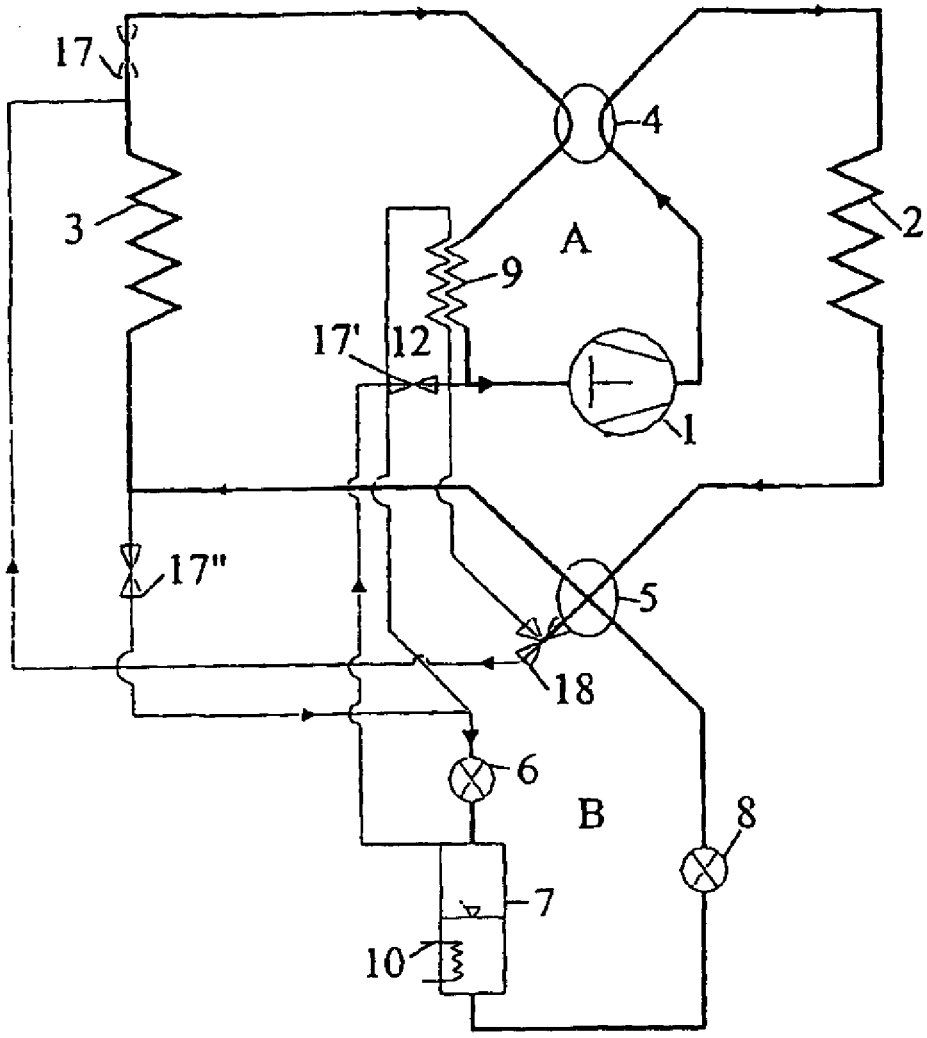
FIG. 7, FIG. 8, FIG. 9 and FIG. 10 are schematic representations of defrosting cycles according to present invention applied to further different embodiments.
Figure 8:
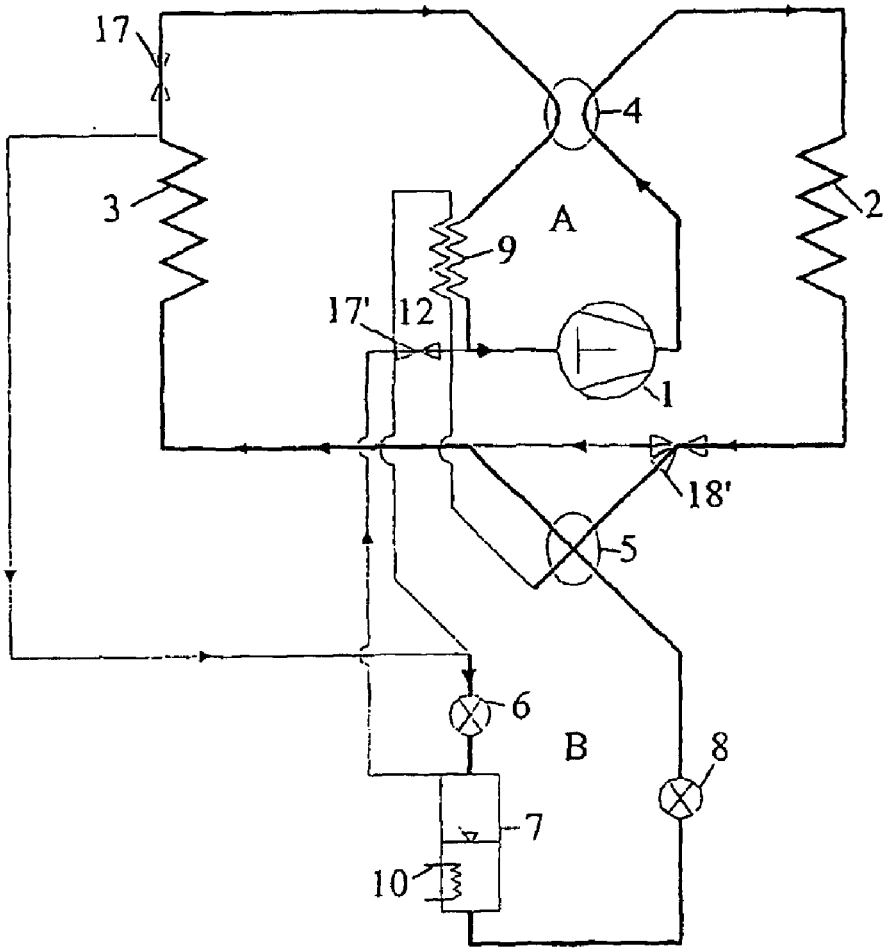
Figure 9:
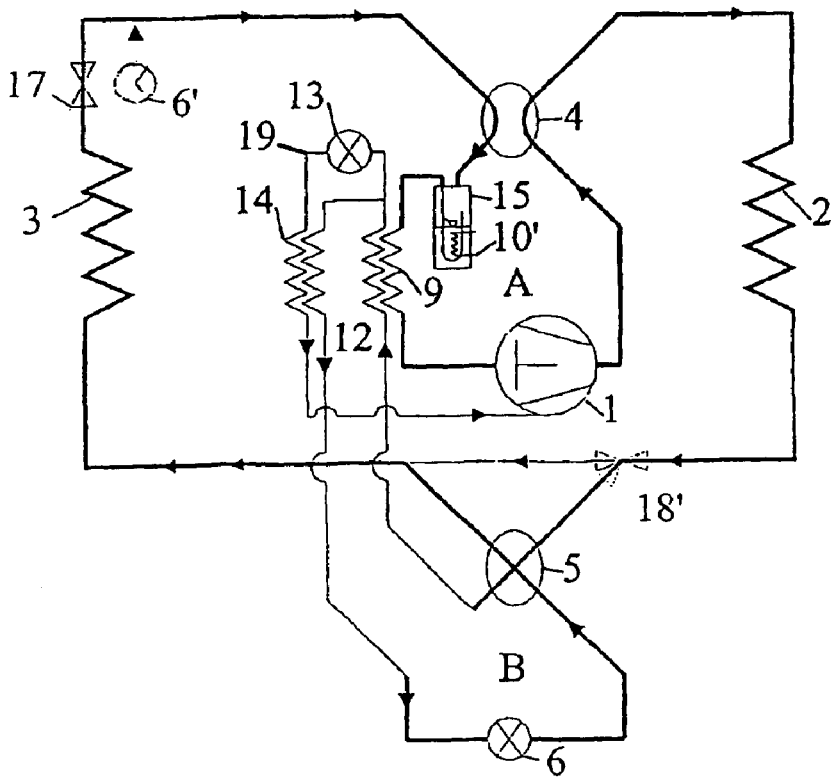
Figure 10:
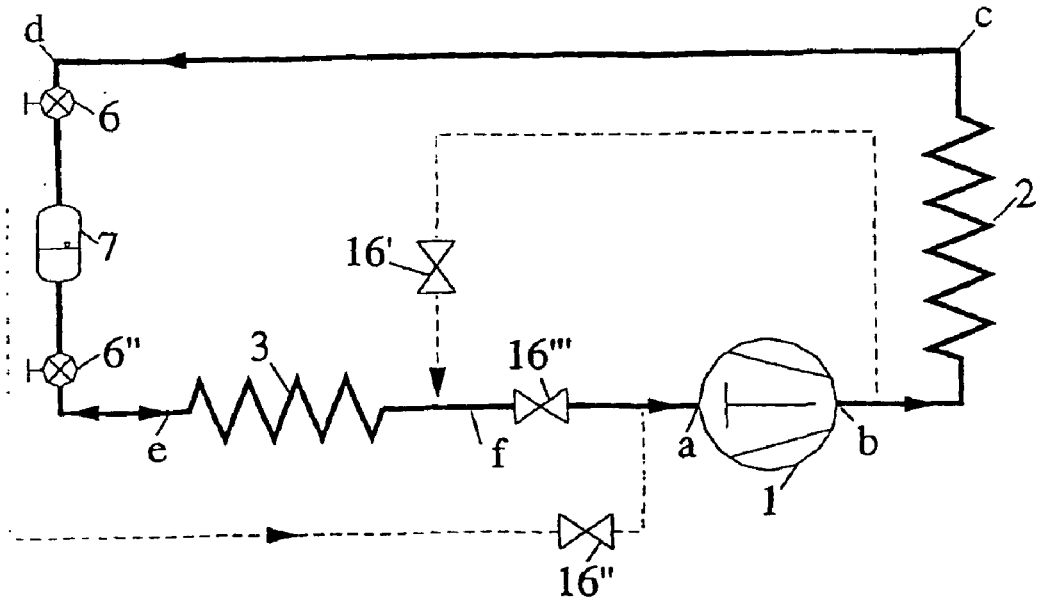
Figure 11:
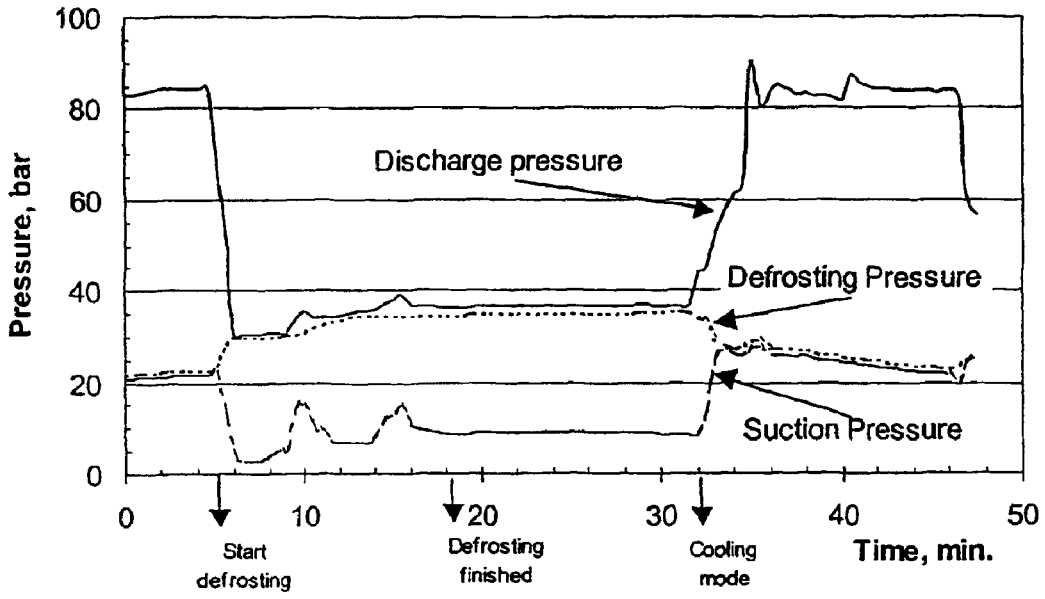
FIG. 11 is a diagram illustrating experimental results from running the defrost cycle of the present invention.

The invention as defined in the attached claims is not limited to the embodiments described above. Thus according to the invention, the defrost cycle can be used with any refrigeration and heat pump system having a receiver/accumulator. This is illustrated in FIGS. 7–9, in which the same defrost cycle is implemented in different embodiments where, for example, flow reversing devices 4 and 5 are provided in sub-process circuits A and B to accomplish a rapid change from heat pump to cooling mode operation. FIG. 10 illustrates the basic defrosting principle, according to the present invention, in which an intermediate pressure receiver is used. The figure illustrates a defrosting cycle for a system in which there is no need for heat rejection by the heat exchanger 2 during the defrosting cycle and in which heat of compression is used as a heating device. During the defrosting cycle, valves 16' and 16" will be open, whereas valve 16'" will be closed. As a result, the high-pressure and temperature gas from the compressor passes through the valve 16' before it enters the heat exchanger 3 which is to be defrosted. The pressure of the cooled refrigerant is then reduced by expansion device valve 6'" to the pressure in the intermediate pressure-receiver 7. Since the receiver is now in direct communication with the suction side of the compressor through a bypass loop which includes the valve 16'", the pressure in the receiver will basically be the same as the compressor's suction pressure. Heat of compression is added to the refrigerant as the suction gas is compressed by the compressor to a higher pressure and temperature. Since there is no external heating device present in the system, the suction pressure of the compressor and that of the pressure receiver 7 will decrease until they reach an equilibrium pressure.

What is claimed is:

1. A method of defrosting a first heat exchanger in a vapor compression system, comprising:

arranging the first heat exchanger to be defrosted, a compressor, a second heat exchanger, and an expansion device so as to be interconnected by conduits to form an integral closed circuit; and aligning the first heat exchanger, the compressor, the second heat exchanger, and the expansion device within the integral closed circuit in such a manner that, during a defrosting cycle of the first heat exchanger, refrigerant in gas form flows through the first heat exchanger at a pressure substantially identical to a pressure of refrigerant gas discharged from the compressor so that the refrigerant in gas form flowing through the first heat exchanger gives off heat to the first heat exchanger to thereby defrost the first heat exchanger.

2. The method of claim 1, further comprising adding heat to the refrigerant in the integral closed circuit using a heating device located at a point along a path of the refrigerant flowing through the integral closed circuit.

3. The method of claim 2, wherein said adding of heat comprises using a heating device located in a pressure receiver.

4. The method of claim 1, further comprising heating the refrigerant during the defrosting cycle using at least one of compression heat from the compressor and heat from a compressor motor.

5. The method of claim 1, further comprising heating the refrigerant during the defrosting cycle using at least one of heat accumulated in the second heat exchanger, a storage tank, and another part of the integral closed circuit.

6. The method of claim 1, wherein said aligning comprises, during the defrosting cycle of the first heat exchanger, coupling the first heat exchanger and the second heat exchanger in series, supplying the refrigerant gas from the compressor through the second heat exchanger to allow the refrigerant gas to give off some heat, and then supplying the cooled refrigerant gas from the second heat exchanger through the first heat exchanger to defrost the first heat exchanger.

7. The method of claim 1, wherein said aligning comprises, during the defrosting cycle of the first heat exchanger, coupling the first heat exchanger and the second heat exchanger in parallel, and simultaneously supplying the refrigerant gas from the compressor through the first heat exchanger and the second heat exchanger to allow the refrigerant gas to simultaneously give off some heat through both the first heat exchanger and the second heat exchanger.

8. The method of claim 1, wherein said aligning comprises aligning the first heat exchanger, the compressor, the second heat exchanger, and the expansion device so that a refrigeration cycle or heat pump cycle is trans-critical.

9. The method of claim 1, wherein the refrigerant is carbon dioxide.

10. The method of claim 1, wherein said aligning comprises aligning the first heat exchanger, the compressor, the second heat exchanger, and the expansion device so that the defrosting cycle is trans-critical.

11. The method of claim 1, further comprising actively controlling the pressure of the refrigerant gas discharged from the compressor so as to adjust the temperature and specific enthalpy of the refrigerant gas at the outlet of the compressor during the defrosting cycle.

12. The method of claim 1, wherein said arranging further includes arranging a pressure receiver in the integral closed circuit, and said aligning comprises aligning the pressure receiver so that the refrigerant flows through the pressure receiver.

13. A defrosting system for defrosting a first heat exchanger in a vapor compression system, comprising:

said first heat exchanger to be defrosted;

a compressor for discharging refrigerant gas;

a second heat exchanger;

an expansion device;

a first bypass loop having a first valve, said first bypass loop being arranged to bypass said expansion device; and a second bypass loop having a pressure reducing device, said second bypass loop being arranged downstream of said first heat exchanger and being arranged to bypass a second valve downstream of said first heat exchanger, wherein said first heat exchanger, said compressor, said second heat exchanger, said expansion device, said first bypass loop, and said second bypass loop are interconnected by conduits so as to form an integral closed circuit, and wherein said first bypass loop and said second bypass loop are arranged to have refrigerant flowing therethrough during a defrosting cycle of said first heat exchanger.

14. The defrosting system of claim 13, wherein said first bypass loop connects an outlet of said compressor to an inlet of said first heat exchanger to be defrosted.

15. The defrosting system of claim 13, further comprising a pressure receiver in said integral closed circuit.

16. The defrosting system of claim 13, wherein said first heat exchanger and said second heat exchanger are coupled in series.

17. The defrosting system of claim 13, wherein said first heat exchanger and said second heat exchanger are coupled in parallel.

18. The defrosting system of claim 17, further comprising a 3-way valve downstream of said compressor so as to allow at least a portion of the refrigerant gas discharged by said compressor to be directed to said first heat exchanger via said first bypass loop.

19. The defrosting system of claim 13, wherein said first bypass loop is arranged to bypass at least a portion of said second heat exchanger.

20. The defrosting system of claim 13, further comprising a third internal heat exchanger in said integral closed circuit, said first bypass loop being arranged to bypass said third internal heat exchanger.

* * * * *